United States Patent [19]

Tanaka et al.

[11] Patent Number: 4,840,837

[45] Date of Patent: Jun. 20, 1989

[54] HEAT TRANSFER MEDIUM

[75] Inventors: Noriatsu Tanaka; Masami Tokunaga; Tsuyoshi Tanaka; Satoshi Koyama; Keiichi Kikuchi, all of Kanagawa, Japan

[73] Assignee: Pilot Man-Nen-Hitsu Kabushiki Kaisha, Tokyo, Japan

[21] Appl. No.: 214,067

[22] Filed: Jul. 1, 1988

[30] Foreign Application Priority Data

Jul. 2, 1987 [JP] Japan ..... 62-166180

[51] Int. Cl.[4] ..... B41M 5/26

[52] U.S. Cl. ..... 428/216; 428/195; 428/207; 428/212; 428/336; 428/423.1; 428/424.2; 428/424.4; 428/424.8; 428/474.4; 428/476.3; 428/476.9; 428/480; 428/483; 428/484; 428/488.4; 428/516; 428/518; 428/520; 428/913; 428/914

[58] Field of Search ..... 428/195, 207, 212, 213, 428/216, 336, 423.1, 424.2, 424.4, 424.8, 474.4, 476.3, 476.9, 480, 483, 484, 488.1, 488.4, 500, 516, 518, 520, 913, 914

[56] References Cited

FOREIGN PATENT DOCUMENTS 59-224392 12/1984 Japan ..... 428/488.4

62-87391 4/1986 Japan ..... 428/488.4

61-206695 9/1986 Japan ..... 428/488.4

*Primary Examiner*—Ellis P. Robinson

*Assistant Examiner*—P. K. Schwartz

*Attorney, Agent, or Firm*—Sughrue, Mion, Zinn, Macpeak & Seas

[57] ABSTRACT

A heat transfer medium composed of a base material having thereon in order outwardly from the base material;

(a) a colorless or light color heat-fusible transfer layer (A) containing from about 55 to 95 wt % of a wax and from about 5 to 45 wt % of a thermoplastic resin compatible with the wax, based on the whole amount of layer (A); and (b) a heat-softenable ink layer (B) containing from about 50 to 90 wt % of a thermoplastic resin incompatible with the wax in the layer (A) and having adhesion upon heating, from about 3 to 30 wt % of a heat-fusible lubricant, and a coloring material, based on the whole amount of layer (B);

the viscosity of layer (A) being from about 100 c.p. to 1,000 c.p. at a temperature 20° C. higher than the melting point of layer (A) shown by a differential scanning calorimeter.

The heat transfer medium provides transferred images excellent in rubbing resistance and distinctness.

15 Claims, 3 Drawing Sheets

HEAT TRANSFER MEDIUM

FIELD OF THE INVENTION

This invention relates to a heat transfer medium which is applied to a heat transfer printer. More particularly, the invention relates to a heat transfer recording medium having an almost colorless heat-fusible transfer layer between an ink layer and a base material.

BACKGROUND OF THE INVENTION

Recording systems include a heat transfer recording system. Since this system can record on plain papers and the record formed is excellent in storability, the system has been widely used for word processors, fascimiles, label printers, vending machines, etc., each using thermal head.

As a heat transfer medium which is used for the heat transfer recording system, a recording medium having formed on a base material an ink layer containing a binder mainly composed of wax or a resin compounded with a coloring agent has been widely used, but such a recording medium has the disadvantage that when images transferred onto a recording paper from the heat transfer medium are rubbed, the ink film formed on the recording paper is removed or the images are stained to reduce the image quality of the transferred images.

Accordingly, for overcoming this disadvantage, various heat transfer media having an almost colorless fusible transfer layer between the ink layer and the base material have been investigated. Using this heat transfer medium, the images transferred onto a recording paper are composed of ink film portions and colorless film portions overcoated on the ink film portions, and the occurrence of stains by rubbing, etc. can be prevented.

However, many of the ink layers of such heat transfer media are compatible with heat fusible transfer layers used as the colorless interlayers and in this case, both layers are intermixed with each other on transfer of images to reduce the distinctness of prints formed. Furthermore, a heat transfer medium of reducing the melt viscosity of the colorless interlayer for improving the peeling of the ink layer from the base material by the colorless interlayer is known. However, when the application voltage on a thermal head is changed in case of using this heat transfer medium, the transferred images wherein image portions are blurred or image portions are connected with each other to fill blank portions (corresponding to FIG. 4 (*c*)) are formed to give transferred images having poor image quality.

SUMMARY OF THE INVENTION

An object of this invention is, therefore, to provide a heat transfer medium capable of giving transferred images excellent in rubbing resistance and distinctness.

The inventors have discovered that a colorless interlayer having a distinct melting point and a specific melt viscosity range and an ink layer containing a specific thermoplastic resin and a specific lubricant in a specific mixing ratio can provide a heat transfer medium excellent in rubbing resistance and the distinctness of prints and have succeeded in accomplishing the present invention based on the discovery.

More specifically, the invention relates to a heat transfer medium composed of a base material having thereon in order outwardly from the base material:

(a) a colorless or light color heat-fusible transfer layer (A) containing from about 55 to 95 wt % of a wax and from about 5 to 45 wt % of a thermoplastic resin compatible with the wax, based on the whole amount of layer (A); and (b) a heat-softenable ink layer (B) containing from about 50 to 90 wt % of a thermoplastic resin incompatible with the wax in layer (A) and having adhesion upon heating, from about 3 to 30 wt % of a heat-fusible lubricant, and a coloring agent, based on the whole amount of layer (B);

the viscosity of layer (A) being from about 100 c.p. to 1,000 c.p. at a temperature 20° C. higher than the melting point of layer (A) shown by a differential scanning calorimeter.

DETAILED DESCRIPTION OF THE INVENTION

The term "heat-fusible" modifying layer (A) herein means that layer (A) shows liquid state at a temperature higher than the melting point of the wax, and the term "a heat-fusible transfer layer" has the same meaning as the term "a heat-sensitive transfer layer".

The resin used as one component for layer (A) in this invention has an indistinct melting point, and if such a resin alone is used for layer (A), an image transfer faithful to an original picture is not obtained. That is, for obtaining a heat transfer medium excellent in distinctness or clearness of prints, layer (A) itself is required to have a distinct melting point. Thus, in this invention, wax is also used as a component for layer (A).

Examples of waxes for use in this invention are natural waxes such as carnauba wax, candelilla wax, beeswax, montan wax and ozocerite; petroleum waxes such as paraffin wax and microcrystalline wax; and synthetic waxes such as polyethylene wax and Fischer-Tropsch wax. These waxes can be used alone or as a mixture thereof.

Figure 2:
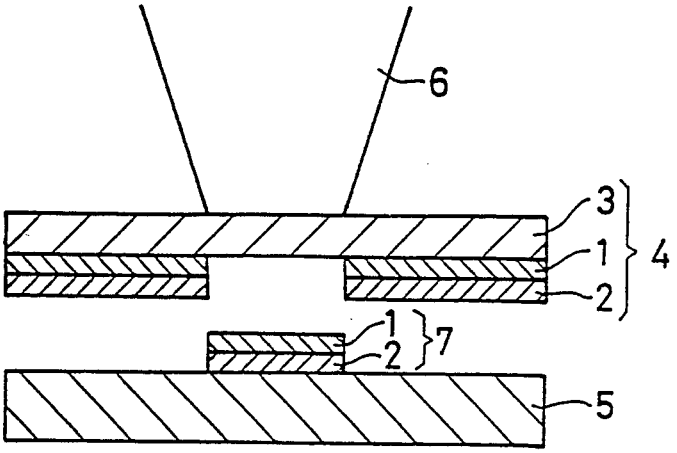
FIG. 2 is a schematic view showing a printing method using the heat transfer medium shown in FIG. 1, and FIG. 3 to FIG. 5 are photographs showing examples of printed patterns.

For obtaining excellent distinctness of the transferred images in layer (A), a wax is used in this invention, but the use of wax alone is not sufficient. In other words, it is necessary that the viscosity of layer (A) be in a definite range, to avoid reducing the image quality of the transferred image at the image transfer. That is, if the viscosity is too low, the transferred images wherein image portions are connected with each other to fill blank portions (corresponding to FIG. 4 (*c*)) are formed and if the viscosity is too high, peeling of the layer due to its poor releasibility and cobwebbing occur to reduce the distinctness of the transferred images. The term "releasibility" herein means a degree of smooth cutting of heat-softenable ink layer, in other words, a degree of sharpness of edge portions of heat-softenable ink layer, in the case where a heat-fusible transfer layer 1 and a heat-softenable ink layer 2 of a heat transfer medium 4 are transferred onto the recording paper 5 in conformity with the heated portion of a thermal head 6, whereby a transferred image 7 is formed in such a manner that the layer 1 is laminated on the layer 2, as shown in FIG. 2. If the releasibility is poor, the sizes of dots become uneven (corresponding to FIG. 5 (*a*)) or both independent dots and irregularly connected portions come to exist (corresponding to FIG. 5 (*b*)).

As the result of the inventors' investigations it has been discovered that the viscosity of layer (A) is required to be in the range of from about 100 c.p. to 1,000 c.p. at a temperature 20° C. higher than the melting point of layer (A) shown by a differential scanning calorimeter (DSC).

In this invention, a resin is added for the aforesaid purpose. When the compounding ratios of the wax and the thermoplastic resin in layer (A) are in the ranges of from about 55 to 95 wt % and from about 5 to 45 wt %, based on the whole amount of layer (A), respectively, layer (A) can be provided with a viscosity of from about 100 c.p. to 1,000 c.p. In this case, the resin must be compatible with the wax, and if the resin is incompatible with the wax, the components separate upon heating and thus the desired viscosity can not be maintained, whereby transferred images having desired distinctness are not obtained. The sentence "the resin is compatible with the wax" herein means that the resin and the wax so uniformly mix each other that no layer boundary can be observed by naked eyes in a molten state upon heating. On the other hand, the sentence "the resin is incompatible with the wax" herein means that the resin and the wax are separated into two layers or suspended in a molten state upon heating, which can be observed by naked eyes.

Examples of suitable compatible thermoplastic resins include petroleum resins, rosin derivatives, coumarone-indene resins, terpene resins, novolak resins, an ethylene-vinyl acetate copolymer, an ethylene-acrylic acid copolymer, polyolefin resins and polyvinyl ether resins. These resins can be used alone or as a mixture thereof. In the aforesaid resins, an ethylene-vinyl acetate copolymer, an ethylene-acrylic acid copolymer, polyolefin and polyvinyl ether are preferably used in this invention.

Now the components for layer (B) are explained in greater detail.

The term "heat-softenable" modifying layer (B) herein means that layer (B) has the viscosity exceeding the range capable of being measured with B-type viscometer and layer (B) has heat-adhesion property at a melting point of layer (A), and the term "a heat-softenable ink layer" has the same meaning as the term "a heat-sensitive transfer ink layer".

The thermoplastic resin used as one component for layer (B) is necessary for increasing the adhesion of layer (B) to a recording paper, and this resin must be incompatible with the wax in layer (A). That is, if a resin having compatibility with the wax in layer (A), such as an ethylene-vinyl acetate copolymer is used for layer (B), layer (A) is mixed with layer (B) upon heating, which results in reducing the distinctness and rubbing resistance of the transferred images and also reducing the adhesion of layer (B) to a recording paper.

Examples of suitable thermoplastic resins incompatible with the wax in layer (A) include vinyl acetate resins, vinyl chloride-vinyl acetate resins, acryl resins, polyester resins, polyamide resins, polyurethane resins, and synthetic rubbers such as styrene butadiene styrene rubber and styren isobutylene styrene rubber. These thermoplastic resins can be used alone or as a mixture thereof. Of these resins, acryl resins, polyester resins and polyamide resins are preferably used in this invention.

Also, for obtaining a heat transfer medium excellent in the distinctness of prints, it is necessary to improve the releasability of layer (B) itself, and for this purpose, a heat-fusible lubricant is used in this invention. The term "heat-fusible" modifying the lubricant herein means that the lubricant is solid at an ordinary temperature but it has a melting point of from 40° C. to 200° C.

The heat-fusible lubricant for use in layer (B), includes the waxes for layer (A) described above as well as fatty acids such as stearic acid and hydroxystearic acid; fatty acid amides such as stearic acid amide and oleic acid amide; fatty acid esters, fatty acid ketons; aliphatic alcohols; partial esters of fatty acids and polyhydric alcohols, such as a glycerol fatty acid ester and a sorbitan fatty acid ester; and composite lubricants such a mixture of the above-described heat-fusible lubricants. These heat-fusible lubricants can be used alone or as a mixture thereof.

It is necessary that the compounding ratios of the thermoplastic resin and the heat-fusible lubricant in layer (B) be in the ranges of from about 50 to 90 wt % and from about 3 to 30 wt %, based on the whole amount of layer (B), respectively. If the ratios are outside these ranges, layer (B) can not be provided with good adhesion to a recording paper and good releasability.

A coloring agent can be selected easily from dyes and pigments, which are generally used in the field of the art, according to the particular purpose and the amount of the coloring agent is from about 2 to 40 wt % base on the whole amount of layer (B). The coloring agents can be used alone or as a mixture thereof.

Examples of suitable dyes include C.I. Solvent Yellow 14, C.I. Solvent Red 81, C.I. Solvent Violet 21, C.I. Solvent Blue 25, C.I. Solvent Green 3, C.I. Solvent Brown 37, C.I. Solvent Black 7, etc. Examples of suitable pigments include white pigments such as zinc oxide, titanium dioxide, etc., black pigments such as carbon black, black iron oxide, etc., yellow pigments such as Benzidine Yellow, Parmanent Yellow HR, etc., orange pigments such as Parmanent Orange GTR, Vulcan Fast Orange GG, etc., red pigments such as Lake Red C, Brilliant Carmine 6B, etc., violet pigments such as Fast Violet B, etc., blue pigments such as Prussian Blue, Phthalocyanine Blue, etc., green pigments such as Pigment Green B, Phthalocyanine Green, etc., fluorescent pigments such as zinc sulphide, zinc silicate, etc., metallic powder pigments such as aluminum powder, bronze powder, copper powder, etc.

It is preferred that the thickness of layer (A) is in the range of from about 1 to 6 μm, the thickness of layer (B) is in the range of from about 1 to 6 μm, and the thickness of the sum of layer (A) and layer (B) is in the range of from about 2 to 7 μm. It is more preferred that the thickness of layer (A) is in the range of from about 2 to 4 μm, and the thickness of layer (B) is in the range of from about 1 to 3 μm.

As the base material for the heat transfer medium of this invention, films of about 20 μm or less in thickness, such as a polyester film, a polysulfone film and a polyacetal film are preferred.

For obtaining the heat transfer medium of this invention, the compositions for layer (A) described above can be formed on a base material by either a hot melt coating method or a solvent coating method, but the compositions for layer (B) described above can be formed on the layer (A) by a solvent coating method wherein a solvent which does not dissolve the layer (A) such as alcohol series solvents, ester series solvents, ketone series solvents, etc., is used and the coated layer (B) is dried at a temperature lower than the melting point of layer (A).

Now the heat transfer medium of this invention is explained by referring to the accompanying drawings.

Figure 1:
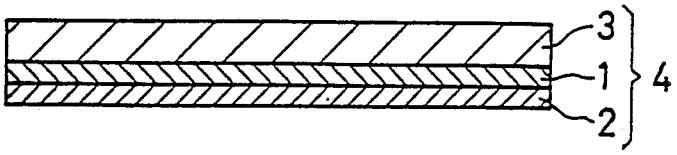
FIG. 1 is a schematic sectional view showing a heat transfer medium of this invention.

FIG. 1 is a schematic sectional view showing an example of the heat transfer medium of this invention and FIG. 2 is a schematic view showing an example of a printing method using the heat transfer medium shown in FIG. 1.

As shown in FIG. 1, the heat transfer medium 4 is composed of a base material 3 having formed thereon a heat-fusible transfer layer 1 and a heat-softenable ink layer 2.

In FIG. 2, the heat transfer medium 4 is disposed on a recording paper 5, a thermal head 6 is pressed the assembly, and plural heating portions of the thermal head 6 are heated according to print information while pressing with the thermal head 6 to selectively heat transfer medium 4, whereby layers 2 and 1 are transferred onto the recording paper 5 in a pattern corresponding to the heated portions of the thermal head, to form a transferred image 7. In the image, even when the recording paper 5 is composed of an impermeable film such as a polyester film, the ink film 2 strongly adheres to the recording paper and further the colorless film 1 is laminated on the ink layer 2.

The present invention is now explained in greater detail with reference to specific embodiments, by means of the following examples, which are not to be construed as limiting the scope of the present invention. Unless otherwise indicated, all parts, percents and ratios are by weight.

The examples of this invention and comparison examples are as follows

Comparison Example 1 is an example using a layer (A) having a viscosity of less than 100 c.p.

Comparison Example 2 is an example using a layer (A) having a viscosity of over 1,000 c.p.

Comparison Example 3 is an example using a layer (B) composed of a resin and a coloring agent only without containing a lubricant.

Comparison Example 4 is an example using a layer (B) containing a lubricant in an amount of over 30%.

Comparison Example 5 is an example using a layer (B) containing a lubricant in an amount of less than 2%.

Comparison Example 6 is an example using a layer (A), in which the resin is incompatible with the wax.

Comparison Example 7 is an example using a layer (A) composed of a resin only.

Comparison Example 8 is an example using a layer (A) composed of a wax only.

Comparison Example 9 is an example using a layer (B) containing a resin which is compatible with the wax in layer (A).

The details of the aforesaid comparison examples are shown in Table 1 below, together with the details of the examples of this invention shown below.

Example 1

A coating composition (a) was prepared by heating the mixture of the following components to 120° C. to melt them and stirring them using an oscillating type agitator manufactured by Shimazaki Seisakuso to form a uniform composition.

Microcrystalline Wax 64%
Low Molecular Weight Polyethylene 21%
Ethylene-vinyl acetate Copolymer 15%

The melting point of the composition measured by DSC was 80° C. and the viscosity thereof at a temperature of 100° C. (i.e., a temperature 20° C. higher than the melting point of the composition) measured by a B-type viscometer was 120 c.p.

Furthermore, a coating composition (b) composed of the following components was prepared.

| | | |
|---|---|---|
| Ink Composition | 25 | parts |
| Polyamide Resin | 63% | |
| Stearic Acid Amide | 6% | |
| Carbon Black (particle diameter: about 24 mμ) | 31% | |
| | 100% | |
| Solvent | 75 | parts |
| Isopropyl Alcohol | 100% | |

The coating composition (b) was prepared by dissolving the polyamide resin and strearic acid amide in isopropyl alcohol, adding thereto carbon black, and mixing and dispersing them using Attritor manufactured by Mitsuimiike Seisakusho to form a uniform composition.

The coating composition (a) prepared above was coated on a polyester film of 3.5 μm in thickness by a hot melt coating method.

Then, the coating composition (b) was coated thereon by a gravure coating method and the coated film was passed through a drying furnace kept at 80° C. to evaporate off the isopropyl alcohol in the coated layer of the coating composition (b).

Thus, a heat transfer ribbon having a heat-fusible transfer layer of 2 μm in thickness and a heat-softenable ink layer of 3 μm in thickness on the polyester film was obtained.

TABLE 1

| | Heat-Fusible Transfer Layer [Layer (A)] | | | | Heat-Softenable Ink Layer [Layer (B)] | | | Test Result | | | |
|---|---|---|---|---|---|---|---|---|---|---|---|
| | Wax (%) | Resin (%) | M.P. (°C.) | Viscosity (c.p.) | Resin (%) | Lubricant (%) | Coloring Agent (%) | Distinctness | Transfer Property | Rubbing Resistance | Fixing Property |
| Example 1 | Microcrystalline Wax*C (64)<br>Low Mol. Weight Polyethylene*B (21) | Ethylene-Vinyl Acetate Copolymer*J (15) | 80 | 120 | Polyamide Resin*R (63) | Stearic Acid Amide (6) | Carbon Black (31) | A | O | 1 | O |
| Example 2 | Microcrystalline Wax*C (60)<br>Low Mol. Weight Polyethylene*B (20) | Ethylene-Vinyl Acetate Copolymer*J (20) | 80 | 420 | Polyamide Resin*Q (56) | Stearic Acid Amide (14) | Carbon Black (30) | A | O | 1 | O |
| Example 3 | Microcrystalline Wax*C (50)<br>Low Mol. Weight Polyethylene*D (20) | Ethylene-Vinyl Acetate Copolymer*K (30) | 80 | 990 | Polyamide Resin*S (63) | Methyl 12-hydroxy-stearate (6) | Carbon Black (31) | A | O | 1 | O |
| Example 4 | Microcrystalline Wax*G (30)<br>Low Mol. Weight Polyethylene*E (30)<br>Paraffin Wax*H (30) | Ethylene-Vinyl Acetate Copolymer*K (10) | 71 | 420 | Polyamide Resin*S (52) | Stearic Acid Amide (28) | Carbon Black (20) | A | O | 1 | O |
| Example 5 | Microcrystalline Wax*G (60)<br>Low Mol. Weight Polyethylene*E (20) | Ethylene-Vinyl Acetate Copolymer*K (20) | 71 | 420 | Polyamide Resin*Q (63) | Oleic Acid Amide (3) | Carbon Black (34) | A | O | 1 | O |
| Example 6 | Microcrystalline Wax*G (60)<br>Low Mol. Weight Polyethylene*E (20) | Ethylene-Vinyl Acetate Copolymer (20) | 71 | 420 | Acryl Resin*P (56) | Methyl 12-hydroxy-stearate (17) | Carbon Black (27) | A | O | 1 | O |
| Example 7 | Microcrystalline Wax*G (30)<br>Low Mol. Weight Polyethylene*B (30)<br>Synthetic Wax*I (30) | Petroleum Resin*M (10) | 68 | 150 | Polyamide Resin*R (53) | Oleic Acid Amide (16) | Carbon Black (31) | A | O | 1 | O |
| Example 8 | Carnauba Wax (40)<br>Paraffin Wax*H (20) | Polyisobutylene*N (40) | 75 | 325 | Acryl Resin*P (56) | Methyl 12-hydroxy-stearate (16) | Carbon Black (28) | A | O | 1 | O |
| Example 9 | Microcrystalline Wax*C (60)<br>Low Mol. Weight Polyethylene*B (20) | Ethylene-Vinyl Acetate Copolymer*J (20) | 80 | 420 | Polyamide Resin*R (84) | Oleic Acid Amide (6) | Permanent Red (10) | A | O | 1 | O |
| Comparison Example 1 | Synthetic Wax*A (53)<br>Low Mol. Weight Polyethylene*B (27) | Ethylene-Vinyl Acetate Copolymer*K (10)<br>Terpene Resin*L (10) | 70 | 95 | Polyamide Resin*Q (59) | Stearic Acid Amide (12) | Carbon Black (29) | B | O | 1 | O |
| Comparison Example 2 | Microcrystalline Wax*C (70) | Ethylene-Vinyl Acetate Copolymer*J (30) | 80 | 1200 | Polyamide Resin*S (59) | Oleic Acid Amide (6) | Carbon Black (35) | C | Δ | 1 | O |
| Comparison Example 3 | Microcrystalline Wax*G (30)<br>Low Mol. Weight Polyethylene*E (30)<br>Paraffin Wax*H (30) | Ethylene-Vinyl Acetate Copolymer*K (10) | 71 | 420 | Acryl-Resin*P (67) | — | Carbon Black (33) | C | Δ | 1 | O |
| Comparison Example 4 | Microcrystalline Wax*G (30)<br>Low Mol. Weight Polyethylene*E (30) | Ethylene-Vinyl Acetate Copolymer*K (10) | 71 | 420 | Polyamide Resin*R (46) | Oleic Acid Amide (32) | Carbon Black (22) | B | O | 2 | Δ |

TABLE 1-continued

| | Heat-Fusible Transfer Layer [Layer (A)] | | | | Heat-Softenable Ink Layer [Layer (B)] | | | Test Result | | | |
|---|---|---|---|---|---|---|---|---|---|---|---|
| | Wax (%) | Resin (%) | M.P. (°C.) | Viscosity (c.p.) | Resin (%) | Lubricant (%) | Coloring Agent (%) | Distinctness | Transfer Property | Rubbing Resistance | Fixing Property |
| Comparison Example 5 | Paraffin Wax*$^{H}$ (30)<br>Microcrystalline Wax*$^{G}$ (30)<br>Low Mol. Weight Polyethylene*$^{E}$ (30) | Ethylene-Vinyl Acetate Copolymer*$^{K}$ (10) | 71 | 420 | Polyester Resin*$^{F}$ (65) | Carnauba Wax (2) | Carbon Black (33) | B | O | 1 | O |
| Comparison Example 6 | Paraffin Wax*$^{H}$ (30)<br>Microcrystalline Wax*$^{C}$ (60)<br>Low Mol. Weight Polyethylene*$^{B}$ (20) | Acryl Resin*$^{O}$ (20) | (*) | (*) | Acryl Resin*$^{P}$ (56) | Methyl 12-hydroxy-stearate (16) | Carbon Black (28) | C | Δ | 1 | O |
| Comparison Example 7 | — | Ethylene-Vinyl Acetate Copolymer*$^{K}$ (100) | 85 | $>10^5$ (**) | Acryl Resin*$^{P}$ (56) | Methyl 12-hydroxy-stearate (16) | Carbon Black (28) | C | X | 1 | O |
| Comparison Example 8 | Paraffin Wax*$^{H}$ (100) | — | 76 | 8 | Ethylene-Vinyl Acetate Copolymer*$^{K}$ (70) | Carnauba Wax (10) | Carbon Black (20) | B | Δ | 3 | X |
| Comparison Example 9 | Microcrystalline Wax*$^{C}$ (50)<br>Low Mol. Weight Polyethylene*$^{D}$ (20) | Ethylene-Vinyl Acetate Copolymer*$^{K}$ (30) | 80 | 990 | Ethylene-Vinyl Acetate Copolymer*$^{K}$ (70) | Carnauba Wax (10) | Carbon Black (20) | C | X | 2 | X |

(*): Unmeasurable caused by separation
(**): Unmeasurable

Examples 2 to 9, Comparison Examples 1 to 5, 8 and 9

By following the same procedure as in Example 1 except that the compositions for the layers were changed as shown in Table 1 described above, heat transfer ribbons were prepared.

Comparison Examples 6 and 7

By following the same procedure as in Example 1 except that 100 parts of ethyl acetate and 100 parts of toluene were added to 100 parts of each of the compositions for layer (A), the mixtures were fused and dispersed, and the dispersed products were coated, heat transfer ribbons were obtained.

In addition, the materials used in the examples and the comparison examples shown in Table 1 above were as follows.

*A: M.p. 78° to 80° C.
Kao Wax T-1, trade name, made by Kao Corporation.

*B: Molecular weight 1,000, m.p. 109° C.
HI-WAX 110P, trade name, made by Mitsui Petrochemical Industries, Ltd.

*C: M.p. 88° C.
HI-MIC3090, trade name, made by Nippon Seiro K.K.

*D: Molecular weight 3,000, m.p. 93° C.
HI-WAX 4252E, trade name, made by Mitsui Petrochemical Industries, Ltd.

*E: Molecular weight 2,000, drop point 106° C.
AC-Polyethylene #6, trade name, made by Allied Chemical Corporation.

*F: Molecular weight 7,600, fluid point 89° C.
Chemit KM-6803, trade name, made by Toray Industries, Inc.

*G: M.p. 75° C.
HI-MIC 2065, trade name, made by Nippon Seiro K.K.

*H: M.p. 73.6° C.
HNP-10, trade name, made by Nippon Seiro K.K.

*I: M.p. 72° to 76° C., viscosity 160 to 200 c.p. (at 100° C.)
Diacarna 30, trade name, made by Mitsubishi Chemical Industries Ltd.

*J: M.I. 400, vinyl acetate 28, softening point 85° C. (ring and ball method),
EVA #210, trade name, made by Mitsui Petrochemical Industries, Ltd.

*K: M.I. 400, vinyl acetate 19, softening point 90° C.
EVA #410, trade name, made by Mitsui Petrochemical Industries, Ltd.

*L: Molecular weight 630, softening point 105° C.
Clearon M105, trade name, made by Yasuhara Yushi K.K.

*M: Molecular weight 3,000, softening point 95° to 105° C.
Escorez 1202U, trade name, made by Esso

*N: Average mol. weight 30,000
Tetrax 3T, trade name, made by Nippon Oil Company, Ltd.

*0: Average mol. weight 65,000, TG. 55° C. Dianal BR 64, trade name, made by Mitsubishi Rayon Co., Ltd.

*P: Molecular weight 180,000, TG. 20° C.
Dianal BR 112, trade name, made by Mitsubishi Rayon Co., Ltd.

*Q: Softening point 103° C.
Sanmide 615A, trade name, made by Sanwa Kagaku K.K.

*R: Softening point 100° C.
Sanmide 550D, trade name, made by Sanwa Kagaku K.K.

*S: Softening point 111° C.
Sanmide 611 DK-1, trade name, made by Sanwa Kagaku K.K.

(1) Distinctness comparison Test:

Printing was performed by a word processor (Bungo Mini 7G, trade name, made by NEC Corporation) using each of the heat transfer ribbons obtained above.

The thermal head equipped with the aforesaid word processor had 24 heating elements and by selectively heating the heating elements, a checkered pattern each dot of which had a dimention of 0.1×0.125 mm and corresponded to each heating element was transferred onto a recording paper. The state of the pattern obtained on the recording paper was observed by means of a microscope at about 40×. In addition, a plain paper was used as the recording paper and printing was performed both by applying a low voltage to the thermal head and by applying a high voltage thereto.

Figure 3A:
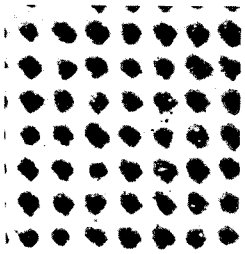
Figure 3B:
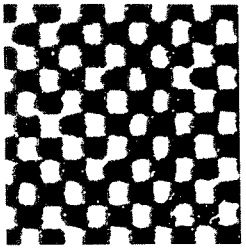

FIG. 3(*a*) shows a sample of the printed pattern produced on the recording paper by the heat transfer ribbon in Example 2 at the application of low voltage.

FIG. 3(*b*) shows a sample of the printed pattern produced by the heat transfer ribbon in Example 2 at the application of high voltage.

Figure 4A:
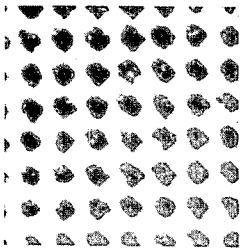
Figure 4B:
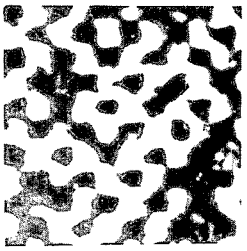
Figure 4C:
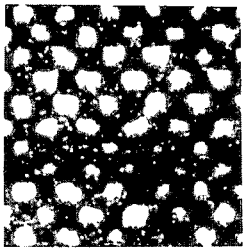

FIG. 4(*a*) shows a sample of the printed pattern produced by the heat transfer ribbon in Comparison Example 1 at the application of low voltage.

FIG. 4(*b*) shows a sample of the printed pattern produced by the heat transfer rbbon in Comparison Example 1 at the application of high voltage.

FIG. 4(*c*) shows a sample of the printed pattern produced by the heat transfer ribbon in Comparison Example 8 at the application of high voltage.

Figure 5A:
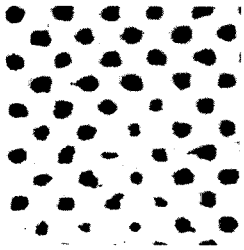
Figure 5B:
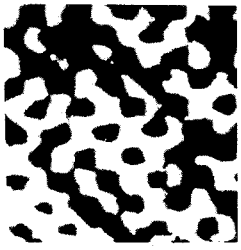

FIG. 5(*a*) shows a sample of the printed pattern produced by the heat transfer ribbon in Comparison Example 2 at the application of low voltage.

FIG. 5(*b*) shows a sample of the printed pattern produced by the heat transfer ribbon in Comparison Example 2 at the application of high voltage Evaluation of Distinctness A: Each dot in the print at the application of low voltage had a uniform size (corresponding to Fig. 3(*a*)) and a fine transfer was obtained on every other dot in the print at the application of high voltage (corresponding to FIG. 3(*b*)).

B: Each dot in the print at the application of low voltage had a uniform size (corresponding to Fig. 4(*a*)), but in the print at the application of high voltage, independent dots and irregularly connected portions existed (corresponding to FIG. 4(*b*)), or dots were connected with each other to fill blank portions (corresponding to FIG. 4(*c*)).

C: the sizes of dots in the print at the application of low voltage were uneven (corresponding to FIG. 5(*a*)) and independent dots and irregularly connected portions existed in the print at the application of high voltage (corresponding to FIG. 5(*b*))

(2) Transfer Property Comparison Test:

Various letters were printed by the aforesaid word processor and the state of ink remaining in each heat transfer medium after transferring was observed by means of a microscope.

Evaluation of Transfer Property

O: Ink in the heated portions of the medium was transferred and no ink remained on the base material in the portions.

Δ: Ink in the heated portions was partially not transferred and a residue of ink was observed in the portions.

x: No ink in the heated portions was transferred or ink in the heated portions was only partially transferred.

(3) Rubbing Resistance Comparison Test:

After performing printing using a heat transfer printer for labels (BC-8 II, trade name, made by Autonicks K.K.) at a printing voltage of 11.8 volts and a pulse width of 2.1 msec., a reciprocating motion was applied to the recording paper having the print while applying a load of 1 kg/cm$^2$ onto the prints on the recording paper through a test paper having the same quality as the recording paper by using a plane rubbing test machine, and then the states of stains at the circumferences of the prints and on the test paper were observed.

Evaluation of Rubbing Resistance

1: No stain formed even after 30 reciprocations.

2: Both the prints and test paper were stained by 10 reciprocations.

3: Both the prints and test paper were markedly stained by 5 reciprocations.

(4) Fixing Property Comparison Test:

Prints were formed on a polyester film by the aforesaid conditions, the prints were rubbed by a plane rubbing test machine, the state of the remaining prints was observed, and the fixing properties of the prints to the impermeable recording paper were compared.

Evaluation of Fixing Property

O: Prints completely remained and no reduction in density occurred even after 30 reciprocations.

Δ: Ink was partially rubbed off to reduce the density by 30 reciprocations.

x: Ink was completely removed to make the prints unreadable by 30 reciprocations.

As described above, according to this invention a heat transfer medium capable of providing transferred images excellent in rubbing resistance and distinctness is obtained.

While the invention has been described in detail and with reference to specific embodiments thereof, it will be apparent to one skilled in the art that various changes and modifications can be made therein without departing from the spirit and scope thereof.

What is claimed is:

1. A heat transfer medium comprising a base material having thereon in order outwardly from said base material:

(a) a colorless or light color heat-fusible transfer layer (A) comprising from about 55 to 95 wt% of a wax an from about 5 to 45 wt% of a thermoplastic resin compatible with said wax, based on the whole amount of layer; and (b) a heat-softenable ink layer (B) comprising from about 50 to 90 wt% of a thermoplastic resin incompatible with said wax in layer (A) and having adhesion upon heating, from about 3 to 30 wt% of a heat-fusible lubricant selected from the group consisting of a natural wax, a petroleum wax, a synthetic wax, a fatty acid, a fatty acid amide, a fatty acid ester, a fatty acid ketone, an aliphatic alcohol, a partial ester of a fatty acid and a polyhydric alcohol, a nonionic ester series active agent, a block polymer of ethylene oxide and propylene oxide, and a mixture thereof, and a coloring agent, based on the whole amount of layer (B);

the viscosity of layer (A) being from about 100 c.p. to 1,000 c.p. at a temperatrue 20° C. higher than the melting point of layer (A) shown by a differential scanning calorimeter.

2. The heat transfer medium as claimed in claim 1, wherein the thickness of layer (A) is from about 1 to 6 μm; the thickness of layer (B) is from about 1 to 6 μm, and the total thickness of layer (A) and layer (B) is from about 2 to 7 μm.

3. The heat transfer medium as claimed in claim 1, wherein said wax in layer (A) is selected from a natural wax, a petroleum wax, a synthetic wax, and a mixture thereof.

4. The heat transfer medium as claimed in claim 3, wherein said wax is selected from carnauba wax, a paraffin wax, a microcrystalline wax and a low molecular weight polyethylene wax.

5. The heat transfer medium as claimed in claim 1, wherein said wax-compatible thermoplastic resin in layer (A) is selected from a petroleum resin, a rosin derivative, a coumarone-indene resin, a terpene resin, a novolak resin, an ethylene-vinyl acetate copolymer, an ethylene-acrylic acid copolymer, a polyolefin resin, a polyvinyl ether resin, and a mixture thereof.

6. The heat transfer medium as claimed in claim 5, wherein said wax-compatible thermoplastic resin is selected from an ethylene-vinyl acetate copolymer, an ethylene-acrylic acid copolymer, a polyolefin resin and a polyvinyl ether resin.

7. The heat transfer medium as claimed in claim 1, wherein said wax-incompatible thermoplastic resin in layer (B) is selected from a vinyl acetate resin, a vinyl chloride-vinyl acetate resin, an acryl resin, a polyester resin, a polyamide resin, a polyurethane resin, styrene butadiene styrene rubber, styrene isobutylene styrene rubber, and a mixture thereof.

8. The heat transfer medium as claimed in claim 7, wherein said wax-incompatible thermoplastic resin is selected from an acryl resin, a polyester resin and a polyamide resin.

9. The heat transfer medium as claimed in claim 1, wherein said coloring agent in layer (B) is selected from a dye, a pigment, and a mixture thereof.

10. The heat transfer medium as claimed in claim 1 wherein the base material comprises a polyester film, a polysulfone film, or a polyacetal film.

11. The heat transfer medium as claimed in claim 10, wherein said base material has a thickness of at most about 20 μm.

12. The heat transfer medium as claimed in claim 1, wherein said heat-fusible lubricant is selected from stearic acid amide, methyl 12-hydroxystearate and oleic acid amide.

13. The heat transfer medium as claimed in claim 1, wherein said layer (B) comprises from about 2 to 40 wt% of said coloring agent.

14. The heat transfer medium as claimed in claim 1, wherein said layer (A) is colorless.

15. The heat transfer medium as claimed in claim 1, having on the opposite surface of said base material from the side carrying, in succession, said layer (A) and said layer (B) a layer comprising a heat resistance resin.

* * * * *